US011388513B1

(12) United States Patent
Carlile et al.

(10) Patent No.: US 11,388,513 B1
(45) Date of Patent: Jul. 12, 2022

(54) EAR-MOUNTABLE LISTENING DEVICE WITH ORIENTATION DISCOVERY FOR ROTATIONAL CORRECTION OF MICROPHONE ARRAY OUTPUTS

(71) Applicant: Iyo Inc., Redwood City, CA (US)

(72) Inventors: Simon Carlile, San Francisco, CA (US); Jason Rugolo, Mountain View, CA (US); Devansh Gupta, Edison, NJ (US)

(73) Assignee: Iyo Inc., Redwood City, CA (US)

( * ) Notice: Subject to any disclaimer, the term of this patent is extended or adjusted under 35 U.S.C. 154(b) by 0 days.

(21) Appl. No.: 17/211,142

(22) Filed: Mar. 24, 2021

(51) Int. Cl.

| | |
|---|---|
| ***H04R 27/04*** | (2006.01) |
| ***H04R 3/00*** | (2006.01) |
| ***G10L 25/51*** | (2013.01) |
| ***H04R 1/40*** | (2006.01) |
| ***H04R 1/10*** | (2006.01) |

(52) U.S. Cl.
CPC ..... *H04R 3/005* (2013.01); *G10L 25/51* (2013.01); *H04R 1/1016* (2013.01); *H04R 1/1041* (2013.01); *H04R 1/1075* (2013.01); *H04R 1/406* (2013.01); *H04R 2201/401* (2013.01)

(58) Field of Classification Search
CPC .... H04R 3/005; H04R 1/1016; H04R 1/1041; H04R 1/1075; G10L 25/51
See application file for complete search history.

(56) References Cited

U.S. PATENT DOCUMENTS

| | | | |
|---|---|---|---|
| 6,068,589 | A | 5/2000 | Neukermans |
| 8,204,263 | B2 | 6/2012 | Pedersen et al. |
| 8,630,431 | B2 | 1/2014 | Gran |
| 9,459,692 | B1 | 10/2016 | Li |
| 9,510,112 | B2 | 11/2016 | Petersen et al. |
| 9,723,130 | B2 | 8/2017 | Rand |
| 10,142,745 | B2 | 11/2018 | Petersen et al. |
| 10,341,798 | B2 | 7/2019 | Norris et al. |
| 2002/0001389 | A1 | 1/2002 | Amiri et al. |
| 2006/0067548 | A1 | 3/2006 | Slaney et al. |

(Continued)

FOREIGN PATENT DOCUMENTS

| | | | |
|---|---|---|---|
| EP | 2436196 | B1 | 8/2015 |
| EP | 3062528 | A1 | 2/2016 |
| WO | 2012018641 | A2 | 2/2012 |

*Primary Examiner* — Simon King
(74) *Attorney, Agent, or Firm* — Nicholson De Vos Webster & Elliott LLP

(57) ABSTRACT

A technique for rotational correction of a microphone array includes generating first audio signals representative of sounds emanating from an environment and captured with an array of microphones of an ear-mountable listening device; identifying a characteristic human behavior having at least one of a typical head orientation or a typical head motion associated with the characteristic human behavior by monitoring sensors mounted in fixed relation to the array of microphones; determining a rotational position of the array of microphones relative to the ear based at least in part upon identifying the characteristic human behavior; applying a rotational correction to the first audio signals to generate a second audio signal, wherein the rotational correction is based at least in part upon the rotational position; and driving a speaker of the ear-mountable listening device with the second audio signal to output audio into an ear.

21 Claims, 11 Drawing Sheets

(56) References Cited

U.S. PATENT DOCUMENTS

| | | | | |
|---|---|---|---|---|
| 2011/0137209 | A1 | 6/2011 | Lahiji et al. | |
| 2014/0119553 | A1 | 5/2014 | Usher et al. | |
| 2016/0266865 | A1* | 9/2016 | Tsingos | G06F 3/165 |
| 2016/0269849 | A1* | 9/2016 | Riggs | H04S 7/301 |
| 2017/0332186 | A1* | 11/2017 | Riggs | H04S 7/304 |
| 2018/0197527 | A1 | 7/2018 | Guiu et al. | |
| 2020/0213711 | A1 | 7/2020 | Rugolo et al. | |
| 2020/0304930 | A1 | 9/2020 | Lyren et al. | |

* cited by examiner

| SENSOR SIGNATURES | CHARACTERISTIC HUMAN BEHAVIOR | TYPICAL HEAD ORIENTATION/MOTION | EXPECTED SENSOR VALUES |
|---|---|---|---|
| 1) MOTION SIGNATURE COMPONENT1 | WALKING | LEVEL HEAD | VALUES_A |
| 2) MOTION SIGNATURE COMPONENT2<br>AUDIBLE SIGNATURE COMPONENT2 | JOGGING | LEVEL HEAD | VALUES_B |
| 3) MOTION SIGNATURE COMPONENT3 | NODDING | UP & DOWN MOTION | VALUES_C |
| 4) AUDIBLE SIGNATURE COMPONENT4 | DRINKING OR EATING | MOTION_A | VALUES_D |
| ● ● ● | | | |

331

FIG. 8

EAR-MOUNTABLE LISTENING DEVICE WITH ORIENTATION DISCOVERY FOR ROTATIONAL CORRECTION OF MICROPHONE ARRAY OUTPUTS

TECHNICAL FIELD

This disclosure relates generally to ear mountable listening devices.

BACKGROUND INFORMATION

Ear mounted listening devices include headphones, which are a pair of loudspeakers worn on or around a user's ears. Circumaural headphones use a band on the top of the user's head to hold the speakers in place over or in the user's ears. Another type of ear mounted listening device is known as earbuds or earpieces and include individual monolithic units that plug into the user's ear canal.

Both headphones and ear buds are becoming more common with increased use of personal electronic devices. For example, people use headphones to connect to their phones to play music, listen to podcasts, place/receive phone calls, or otherwise. However, headphone devices are currently not designed for all-day wearing since their presence blocks outside noises from entering the ear canal without accommodations to hear the external world when the user so desires. Thus, the user is required to remove the devices to hear conversations, safely cross streets, etc.

Hearing aids for people who experience hearing loss are another example of an ear mountable listening device. These devices are commonly used to amplify environmental sounds. While these devices are typically worn all day, they often fail to accurately reproduce environmental cues, thus making it difficult for wearers to localize reproduced sounds. As such, hearing aids also have certain drawbacks when worn all day in a variety of environments. Furthermore, conventional hearing aid designs are fixed devices intended to amplify whatever sounds emanate from directly in front of the user. However, an auditory scene surrounding the user may be more complex and the user's listening needs may not be as simple as merely amplifying sounds emanating directly in front of the user.

With any of the above ear mountable listening devices, monolithic implementations are common. These monolithic designs are not easily custom tailored to the end user, and if damaged, require the entire device to be replaced at greater expense. Accordingly, a dynamic, multi-use, cost effective, ear mountable listening device capable of providing all day comfort in a variety of auditory scenes is desirable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

FIG. 8 illustrates an example library storing sensor signatures representative of a plurality of different characteristic human behaviors, in accordance with an embodiment of the disclosure.

DETAILED DESCRIPTION

Embodiments of a system, apparatus, and method of operation for an ear-mountable listening device having a microphone array, electronics and inertial measurement unit (IMU) sensors capable of detecting a rotational position of the microphone array and correcting audio output to compensate for rotational changes are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1A:
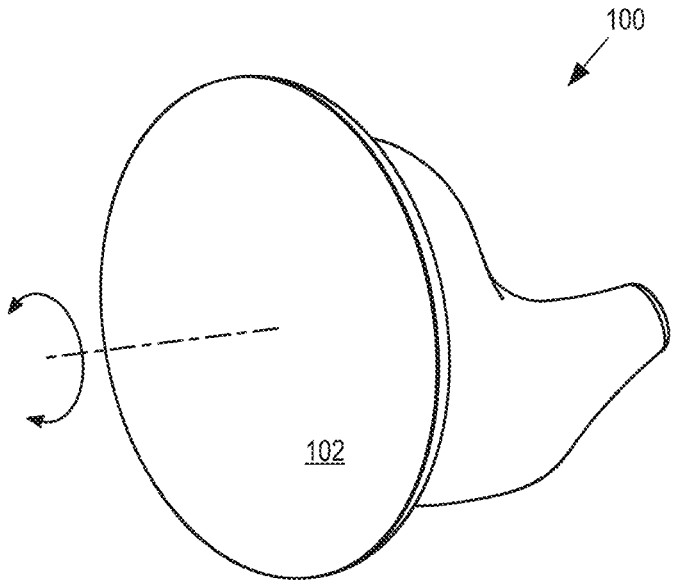
FIG. 1A is a front perspective illustration of an ear-mountable listening device, in accordance with an embodiment of the disclosure.
Figure 1B:
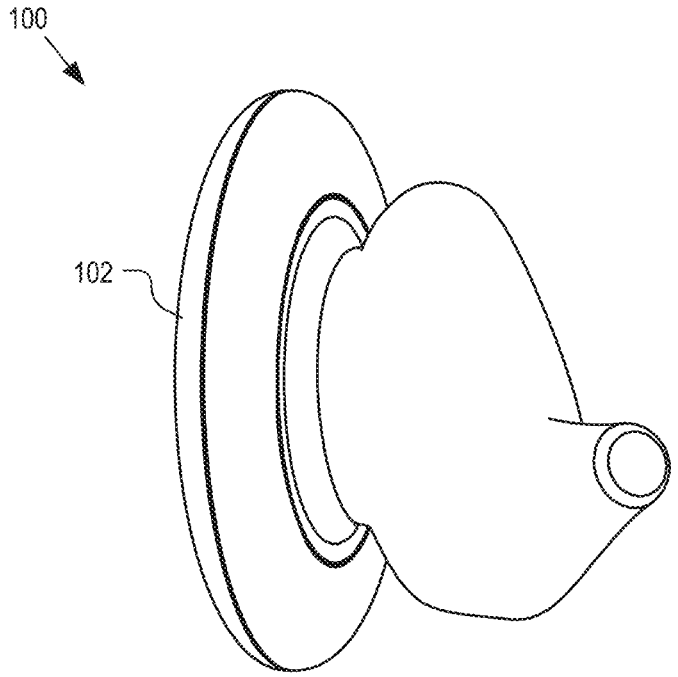
FIG. 1B is a rear perspective illustration of the ear-mountable listening device, in accordance with an embodiment of the disclosure.
Figure 1C:
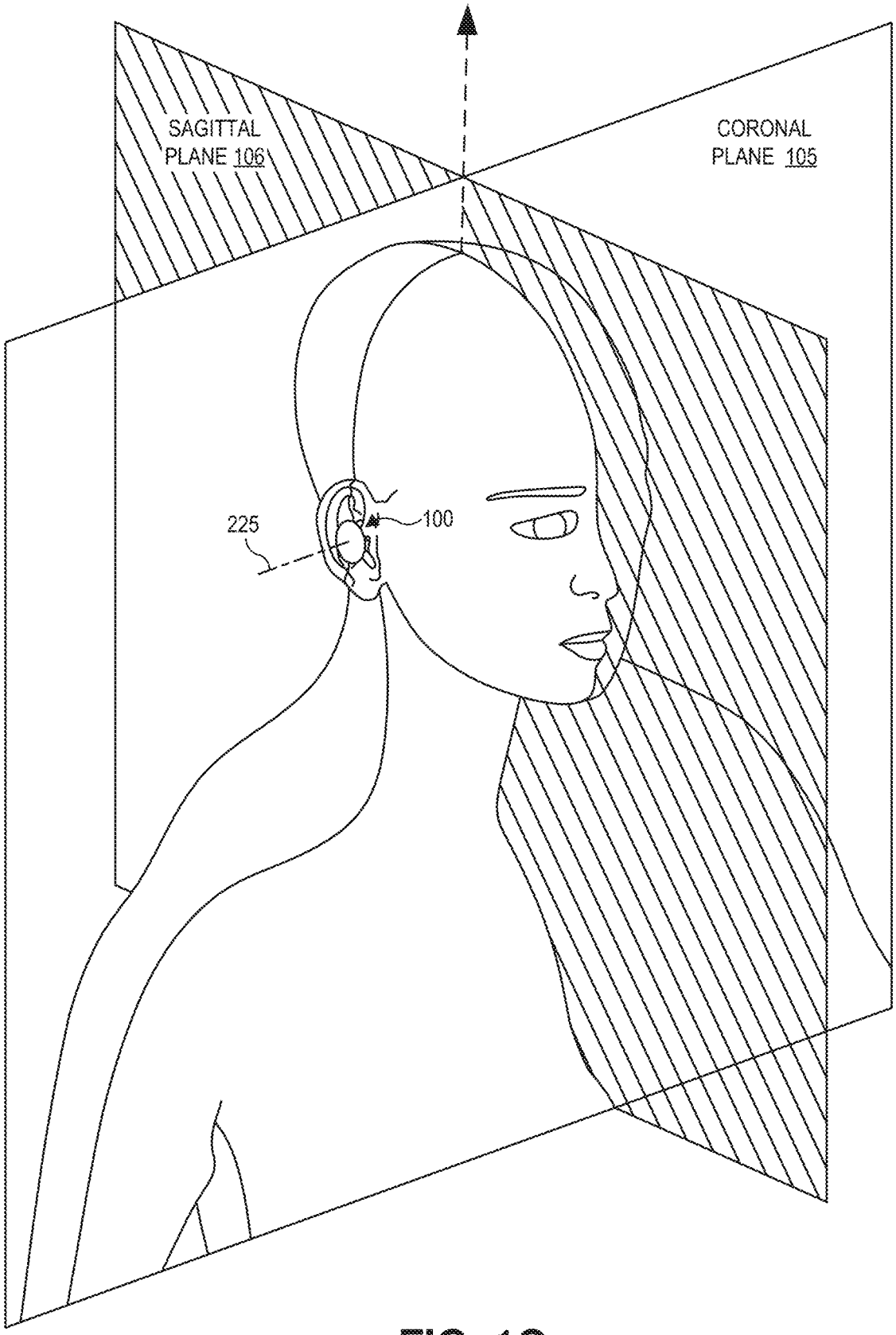
FIG. 1C illustrates the ear-mountable listening device when worn plugged into an ear canal, in accordance with an embodiment of the disclosure.

FIGS. 1A-C illustrate an ear-mountable listening device 100, in accordance with an embodiment of the disclosure. In various embodiments, ear-mountable listening device 100 (also referred to herein as an "ear device") is capable of facilitating a variety auditory functions including wirelessly connecting to (and/or switching between) a number of audio sources (e.g., Bluetooth connections to personal computing devices, etc.) to provide in-ear audio to the user, controlling the volume of the real world (e.g., modulated noise cancellation and transparency), providing speech hearing enhancements, localizing environmental sounds for spatially selective cancellation and/or amplification, and even rendering auditory virtual objects (e.g., auditory assistant or other data sources as speech or auditory icons). Ear-mountable listening device 100 is amenable to all day wearing. When the user desires to block out external environmental sounds, the mechanical design and form factor along with active noise cancellation can provide substantial external noise dampening (e.g., 40 to 50 dB though other levels of attenuation may be implemented). When the user desires a natural auditory interaction with their environment, ear-mountable listening device 100 can provide near (or perfect) perceptual transparency by reassertion of the user's natural Head Related Transfer Function (HRTF), thus maintaining spaciousness of sound and the ability to localize sound origination in the environment based upon the audio output from the ear device. When the user desires auditory aid or augmentation, ear-mountable listening device 100 may be capable of acoustical beamforming to dampen or nullify deleterious sounds while enhancing others based on their different locations in space about the user. The auditory enhancement may select sound(s) based on other differentiating characteristics such as pitch or voice quality and also be capable of amplitude and/or spectral enhancements to facilitate specific user functions (e.g., enhance a specific voice frequency originating from a specific direction while dampening other background noises). In some embodiments, machine learning principles may even be applied to sound segregation and signal reinforcement.

In various embodiments, the ear-mountable listening device 100 includes a rotatable component 102 in which the microphone array for capturing sounds emanating from the user's environment is disposed. Rotatable component 102 may serve as a rotatable user interface for controlling one or more user selectable functions (e.g., volume control, etc.) thus changing the rotational position of the microphone array with respect to the user's ear. Additionally, each time the user inserts or mounts the ear-mountable listening device 100 to their ear, they may do so with some level of rotational variability. These rotational variances of the internal microphone array affect the ability to preserve spaciousness and spatial awareness of the user's environment, to reassert the user's natural HRTF, or to leverage acoustical beamforming techniques in an intelligible and useful manner for the end-user. Accordingly, techniques described herein use various onboard sensors (e.g., IMU sensors) mounted in fixed relation to the rotatable component 102 to determine the rotational position of the microphone array relative to the user's ear. The determined position is then used to apply a rotational correct that compensates for the rotational variances of the microphone array.

Figure 1D:
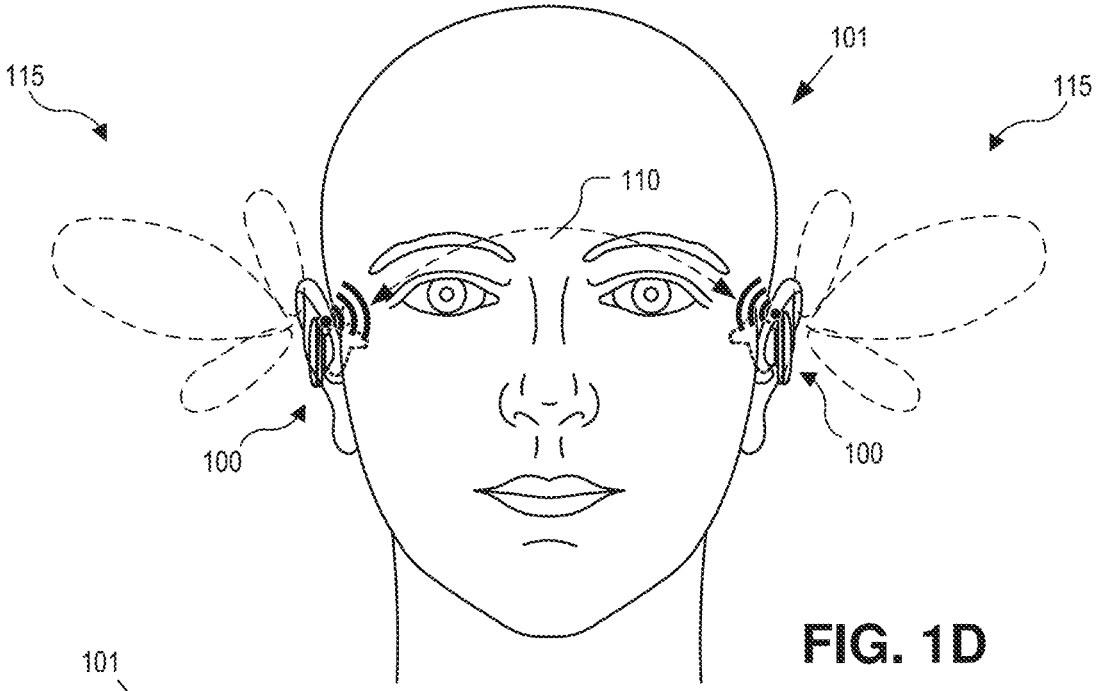
FIG. 1D illustrates a binaural listening system where the microphone arrays of each ear-mountable listening device are linked via a wireless communication channel, in accordance with an embodiment of the disclosure.
Figure 1E:
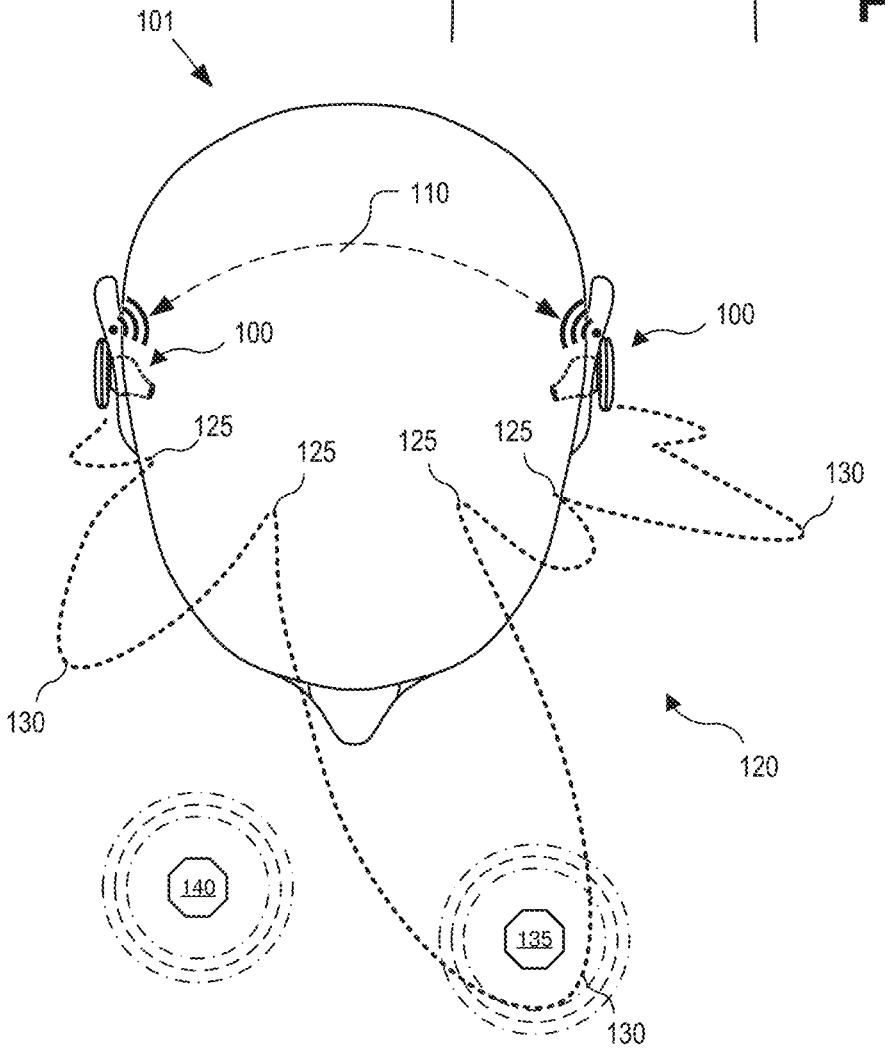
FIG. 1E illustrates acoustical beamforming to selectively steer nulls or lobes of the linked microphone arrays, in accordance with an embodiment of the disclosure.

FIGS. 1D and 1E illustrate how a pair of ear-mountable listening devices 100 can be linked via a wireless communication channel 110 to form a binaural listening system 101. The microphone array (adaptive phased array) of each ear device 100 can be operated separately with its own distinct acoustical gain pattern 115 or linked to form a linked adaptive phased array generating a linked acoustical gain pattern 120. Binaural listening system 101 operating as a linked adaptive phased array provides greater physical separation between the microphones than the microphones within each ear-mountable listening device 100 alone. This greater physical separation facilitates improved acoustical beamforming down to lower frequencies than is capable with a single ear device 100. In one embodiment, the inter-ear separation enables beamforming at the fundamental frequency (f0) of a human voice. For example, an adult male human has a fundamental frequency ranging between 100-120 Hz, while f0 of an adult female human voice is typically one octave higher, and children have a f0 around 300 Hz. Embodiments described herein provide sufficient physical separation between the microphone arrays of binaural listening system 101 to localize sounds in an environment having an f0 as low as that of an adult male human voice, as well as, adult female and children voices, when the adaptive phased arrays are linked across paired ear devices 100.

FIG. 1E further illustrates how the microphone arrays of each ear device 100, either individually or when linked, can operate as adaptive phased arrays capable of selective spatial filtering of sounds in real-time or on-demand in response to a user command. The spatial filtering is achieved via acoustical beamforming that steers either a null 125 or a lobe 130 of acoustical gain pattern 120. If a lobe 130 is steered in the direction of a unique source 135 of sound, then unique source 135 is amplified or otherwise raised relative to the background noise level. On the other hand, if a null 125 is steered towards a unique source 140 of sound, then unique source 140 is cancelled or otherwise attenuated relative to the background noise level.

The steering of nulls 125 and/or lobes 135 is achieved by adaptive adjustments to the weights (e.g., gain or amplitude) or phase delays applied to the audio signals output from each microphone in the microphone arrays. The phased array is adaptive because these weights or phase delays are not fixed, but rather dynamically adjusted, either automatically due to implicit user inputs or on-demand in response to explicit user inputs. Acoustical gain pattern 120 itself may be adjusted to have a variable number and shape of nulls 125 and lobes 130 via appropriate adjustment to the weights and phase delays. This enables binaural listening system 101 to cancel and/or amplify a variable number of unique sources 135, 140 in a variable number of different orientations relative to the user. For example, the binaural listening system 101 may be adapted to attenuate unique source 140 directly in front of the user while amplifying or passing a unique source positioned behind or lateral to the user.

Figure 1F:
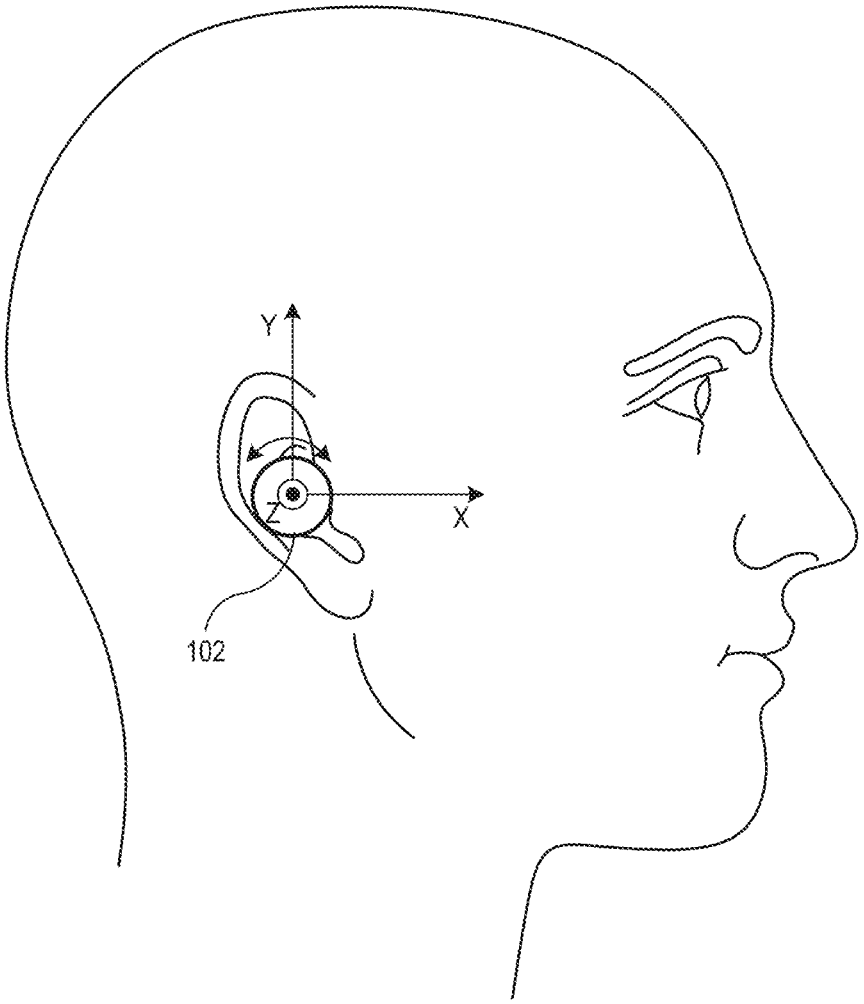
FIG. 1F is a profile illustration depicting how a rotatable component of the ear-mountable listening device spins to provide a user interface, in accordance with an embodiment of the disclosure.

FIG. 1F is a profile illustration depicting how a user can spin rotatable component 102 clockwise or counterclockwise about the Z-axis to adjust a user selectable function (e.g., volume control or otherwise). As rotatable component 102 changes its rotational position relative to the ear, the orientation of the microphone array within rotatable component 102 is also rotated thereby affecting the spatial orientation of the microphones which will affect both the spaciousness of the environmental sounds captured by the microphone array and the orientation of the beamformed peaks and nulls. Accordingly, embodiments described herein identify the current rotational position of rotatable component 102 relative to the user's ear and apply a rotational correction to the captured audio signals to preserves the HRTF and the user's ability to accurately localize sounds in their environment and the listening assistance afforded by the beamforming based upon the audio output from ear-mountable listening device 100.

The rotational position of rotatable component 102 is determined using onboard sensors and/or microphone(s) to look for and identify characteristic human behaviors having associated typical head orientations or typical head motions. For example, two such typical characteristic human behaviors are walking or jogging (other example characteristic human behaviors are discussed below in connection with FIG. 8). Walking or jogging are human behaviors (also referred to as "activities") that can be identified by their associated motions and/or sounds. These motions include rhythmic accelerations along the Y and X axes. When jogging, a user's breathing may increase in intensity shortly after commencing the rhythmic accelerations associated with walking or jogging. A multi-axis motion sensor can be used to identify the rhythmic motions while the microphone array (or an internal microphone) may identify the breathing patterns. Once a characteristic human behavior is identified, typical head orientations or motions can be assumed for the given characteristic human behavior. For example, when walking or jogging humans typically (on average) hold their heads at a level head attitude or level orientation to view obstacles at a distance in front of their paths. The rhythmic accelerations also typically oscillate along defined axes relative to the user's head. The IMU sensors can then measure Earth's constant gravity vector, magnetic field vector, and/or the rhythmic accelerations and compare these current sensor values against expected sensor values associated with the assumed head orientation/motion. Deviations from the expected values can then be used to determine the rotational position of rotatable component 102 (and thus the microphone array) and select the appropriate rotational correction. Accordingly, the techniques described herein leverage the insight that certain motions/sounds can be used to identify characteristic human behaviors (e.g., walking, jogging, nodding, eating, drinking, etc.) and these activities often have typical head orientations/motions associated therewith, which may be used as discernable references for measuring the rotational position of rotational component 102.

In one embodiment, the rotational position of component 102 (including the microphone array) is tracked in real-time as it varies. Variability in the rotational position may be due to variability in rotational placement when the user inserts, or mounts, ear device 100 to his/her ear. Variability may also be due to intentional rotations of component 102 when used as a user interface for selecting/adjusting a user function (e.g., volume control). Once the rotational position of component 102 is determined, an appropriate rotational correction (e.g., rotational transformation) may be applied by the electronics to the audio signals captured by the microphone array, thus enabling preservation of the user's ability to localize sounds in their physical environment, and/or in the hearing assistance afforded by the beamforming, despite rotational changes in component 102 (and the microphone array) relative to the ear.

Figure 2:
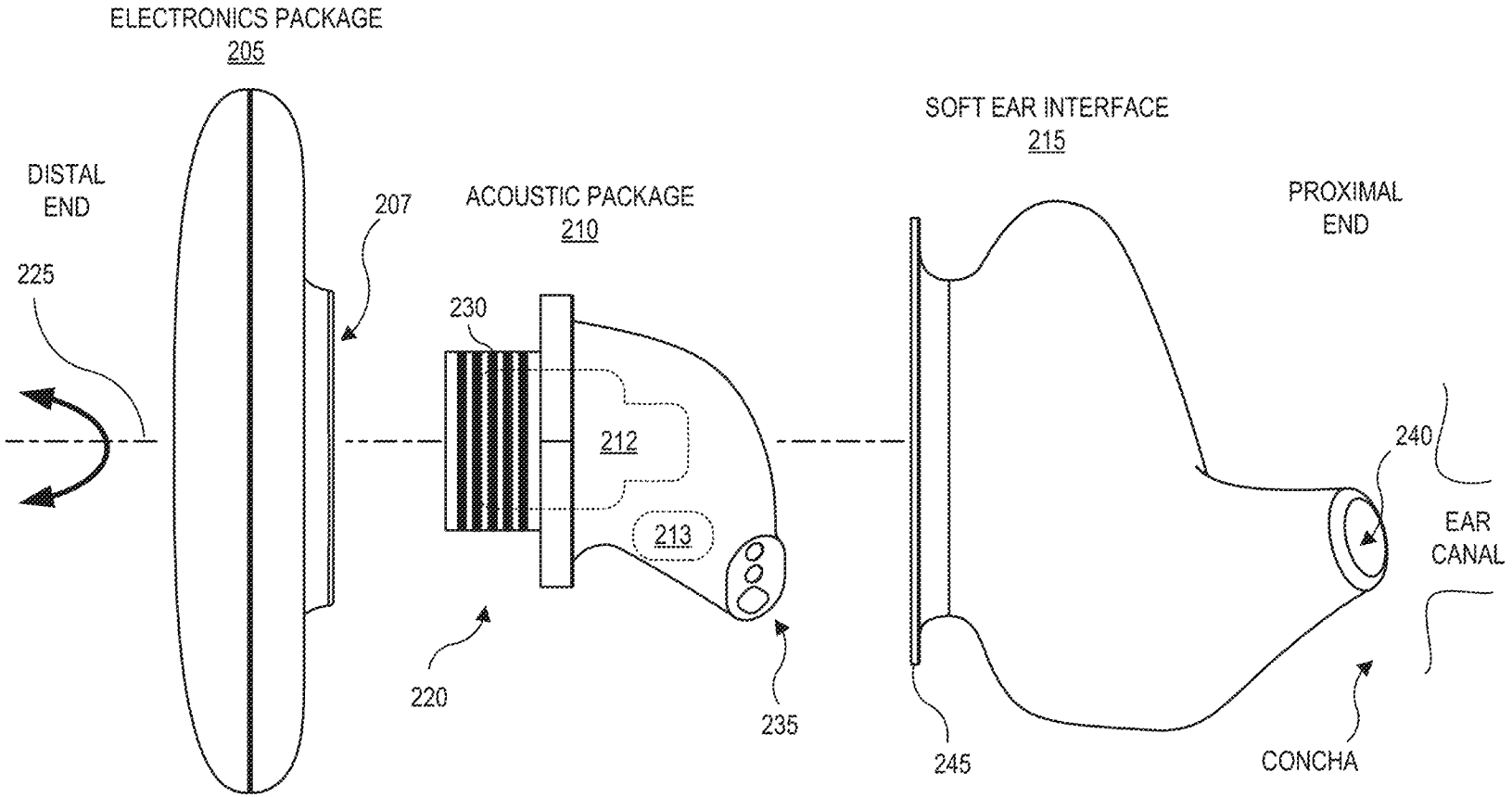
FIG. 2 is an exploded view illustration of the ear-mountable listening device, in accordance with an embodiment of the disclosure.

Referring to FIG. 2, ear-mountable listening device 100 has a modular design including an electronics package 205, an acoustic package 210, and a soft ear interface 215. The three components are separable by the end-user allowing for any one of the components to be individually replaced should it be lost or damaged. The illustrated embodiment of electronics package 205 has a puck-like shape and includes an array of microphones for capturing external environmental sounds along with electronics disposed on a main circuit board for data processing, signal manipulation, communications, user interfaces, and sensing. In some embodiments, the main circuit board has an annular disk shape with a central hole to provide a compact, thin, or close-into-the-ear form factor.

The illustrated embodiment of acoustic package 210 includes one or more speakers 212, and in some embodiments, an internal microphone 213 oriented and positioned to focus on user noises emanating from the ear canal, along with electromechanical components of a rotary user interface. A distal end of acoustic package 210 may include a cylindrical post 220 that slides into and couples with a cylindrical port 207 on the proximal side of electronics package 205. In embodiments where the main circuit board within electronics package 205 is an annular disk, cylindrical port 207 aligns with the central hole (e.g., see FIG. 6B). The annular shape of the main circuit board and cylindrical port 207 facilitate a compact stacking of speaker(s) 212 with the microphone array within electronics package 205 directly in front of the opening to the ear canal enabling a more direct orientation of speaker 212 to the axis of the auditory canal. Internal microphone 213 may be disposed within acoustic package 210 and electrically coupled to the electronics within electronics package 205 for audio processing (illustrated), or disposed within electronics package 205 with a sound pipe plumbed through cylindrical post 220 and extending to one of the ports 235 (not illustrated). Internal microphone 213 may be shielded and oriented to focus on user sounds originating via the ear canal. Additionally, internal microphone 213 may also be part of an audio feedback control loop for driving cancellation of the ear occlusion effect.

Post 220 may be held mechanically and/or magnetically in place while allowing electronics package 205 to be rotated about central axial axis 225 relative to acoustic package 210 and soft ear interface 215. Electronics package 205 represents one possible implementation of rotatory component 102 illustrated in FIG. 1A. This rotation of electronics package 205 relative to acoustic package 210 implements a rotary user interface. The mechanical/magnetic connection facilitates rotational detents (e.g., 8, 16, 32) that provide a force feedback as the user rotates electronic package 205 with their fingers. Electrical trace rings 230 disposed circumferentially around post 220 provide electrical contacts for power and data signals communicated between electronics package 205 and acoustic package 210. In other embodiments, post 220 may be eliminated in favor of using flat circular disks to interface between electronics package 205 and acoustic package 210.

Soft ear interface 215 is fabricated of a flexible material (e.g., silicon, flexible polymers, etc.) and has a shape to insert into a concha and ear canal of the user to mechanically hold ear-mountable listening device 100 in place (e.g., via friction or elastic force fit). Soft ear interface 215 may be a custom molded piece (or fabricated in a limited number of sizes) to accommodate different concha and ear canal sizes/shapes. Soft ear interface 215 provides a comfort fit while mechanically sealing the ear to dampen or attenuate direct propagation of external sounds into the ear canal. Soft ear interface 215 includes an internal cavity shaped to receive a proximal end of acoustic package 210 and securely holds acoustic package 210 therein, aligning ports 235 with in-ear aperture 240. A flexible flange 245 seals soft ear interface 215 to the backside of electronics package 205 encasing acoustic package 210 and keeping moisture away from acoustic package 210. Though not illustrated, in some embodiments, acoustic package 210 may include a barbed ridge that friction fits or "clicks" into a mating indent feature within soft ear interface 215.

FIG. 1C illustrates how ear-mountable listening device 100 is held by, mounted to, or otherwise disposed in the user's ear. As illustrated, soft ear interface 215 is shaped to hold ear-mountable listening device 100 with central axial axis 225 substantially falling within (e.g., within 20 degrees) a coronal plane 105. As is discussed in greater detail below, an array of microphones extends around central axial axis 225 in a ring pattern that substantially falls within a sagittal plane 106 of the user. When ear-mountable listening device 100 is worn, electronics package 205 is held close to the pinna of the ear and aligned along, close to, or within the pinna plane. Holding electronics package 205 close into the pinna not only provides a desirable industrial design (relative to further out protrusions), but may also have less impact on the user's HRTF, or more readily lend itself to a definable/characterizable impact on the user's HRTF, for which offsetting calibration may be achieved. As mentioned, the central hole in the main circuit board along with cylindrical port 207 facilitate this close in mounting of electronics package 205 despite mounting speakers 212 directly in front of the ear canal in between electronics package 205 and the ear canal along central axial axis 225.

Figure 3:
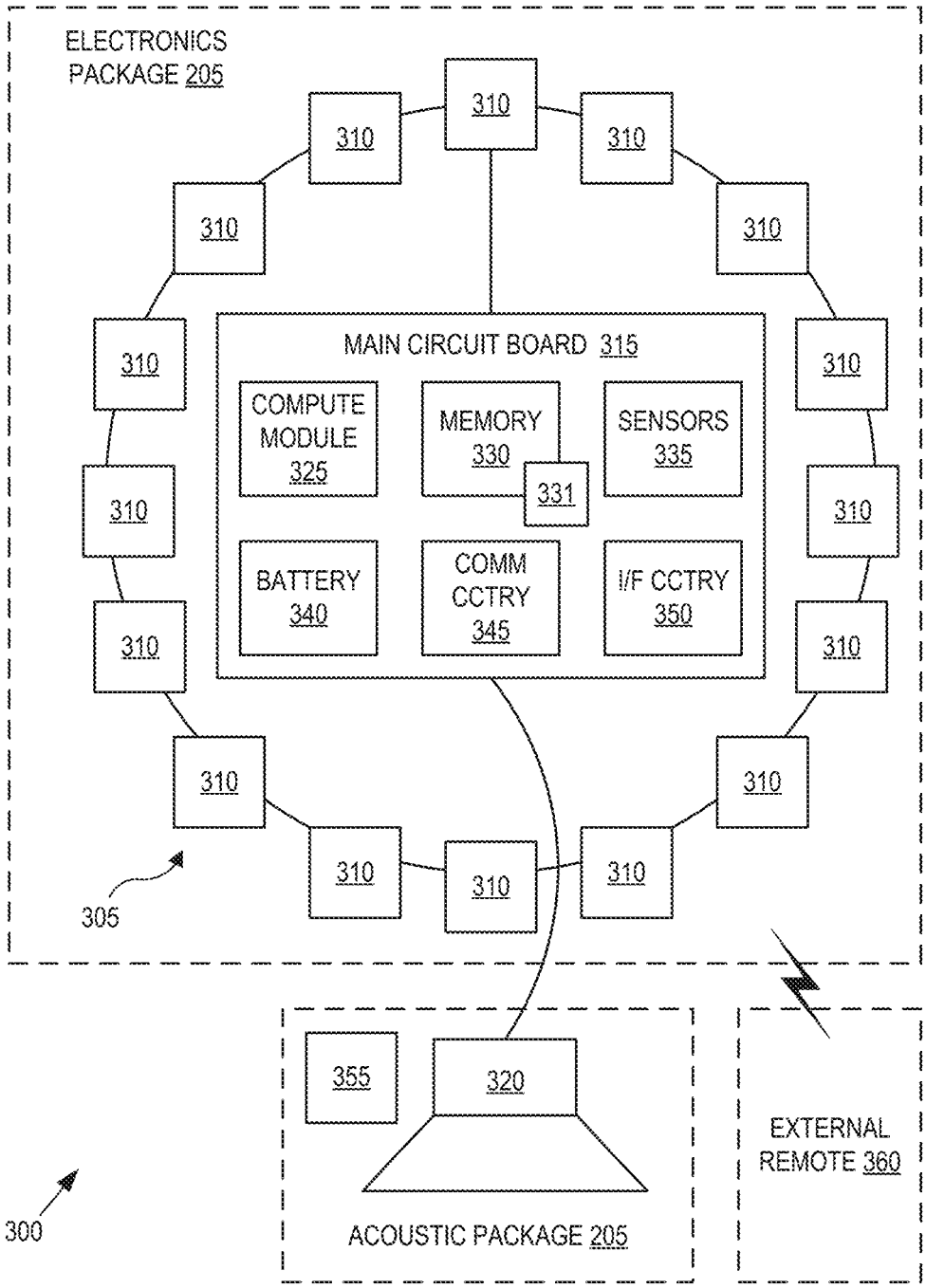
FIG. 3 is a block diagram illustrating select functional components of the ear-mountable listening device, in accordance with an embodiment of the disclosure.

FIG. 3 is a block diagram illustrating select functional components 300 of ear-mountable listening device 100, in accordance with an embodiment of the disclosure. The illustrated embodiment of components 300 includes an array 305 of microphones 310 (aka microphone array 305) and a main circuit board 315 disposed within electronics package 205 while speaker(s) 320 are disposed within acoustic package 205. Main circuit board 315 includes various electronics disposed thereon including a compute module 325, memory 330, sensors 335, battery 340, communication circuitry 345, and interface circuitry 350. The illustrated embodiment also includes an internal microphone 355 disposed within acoustic package 205. Both microphone array 305 and internal microphone 355 may be referred to as onboard microphones. An external remote 360 (e.g., handheld device, smart ring, etc.) is wirelessly coupled to ear-mountable listening device 100 (or binaural listening system 101) via communication circuitry 345. Although not illustrated, acoustic package 205 may also include some electronics for digital signal processing (DSP), such as a printed circuit board (PCB) containing a signal decoder and DSP processor for digital-to-analog (DAC) conversion and EQ processing, a bi-amped crossover, and various auto-noise cancellation and occlusion processing logic.

In one embodiment, microphones 310 are arranged in a ring pattern (e.g., circular array, elliptical array, etc.) around a perimeter of main circuit board 315. Main circuit board 315 itself may have a flat disk shape, and in some embodiments, is an annular disk with a central hole. There are a number of advantages to mounting multiple microphones 310 about a flat disk on the side of the user's head for an ear-mountable listening device. However, one limitation of such an arrangement is that the flat disk restricts what can be done with the space occupied by the disk. This becomes a significant limitation if it is necessary or desirable to orientate a loudspeaker, such as speaker 320 (or speakers 212), on axis with the auditory canal as this may push the flat disk (and thus electronics package 205) quite proud of the ears. In the case of a binaural listening system, protrusion of electronics package 205 significantly out past the pinna plane may even distort the natural time of arrival of the sounds to each ear and further distort spatial perception and the user's HRTF potentially beyond a calibratable correction. Fashioning the disk as an annulus (or donut) enables protrusion of the driver of speaker 320 (or speakers 212) through main circuit board 315 and thus a more direct orientation/alignment of speaker 320 with the entrance of the auditory canal.

Microphones 310 may each be disposed on their own individual microphone substrates. The microphone port of each microphone 310 may be spaced in substantially equal angular increments about central axial axis 225. In FIG. 3, sixteen microphones 310 are equally spaced; however, in other embodiments, more or less microphones may be distributed (evenly or unevenly) in the ring pattern, or other geometry, about central axial axis 225.

Compute module 325 may include a programmable microcontroller that executes software/firmware logic stored in memory 330, hardware logic (e.g., application specific integrated circuit, field programmable gate array, etc.), or a combination of both. Although FIG. 3 illustrates compute module 325 as a single centralized resource, it should be appreciated that compute module 325 may represent multiple compute resources disposed across multiple hardware elements on main circuit board 315 and which interoperate to collectively orchestrate the operation of the other functional components. For example, compute module 325 may execute logic to turn ear-mountable listening device 100 on/off, monitor a charge status of battery 340 (e.g., lithium ion battery, etc.), pair and unpair wireless connections, switch between multiple audio sources, execute play, pause, skip, and volume adjustment commands (received from interface circuitry 350, commence multi-way communication sessions (e.g., initiate a phone call via a wirelessly coupled phone), control volume of the real-world environment passed to speaker 320 (e.g., modulate noise cancellation and perceptual transparency), enable/disable speech enhancement modes, enable/disable smart volume modes (e.g., adjusting max volume threshold and noise floor), or otherwise. In one embodiment, compute module 325 includes trained neural networks.

Sensors 335 may include a variety of sensors such as an inertial measurement unit (IMU) including one or more of a multi-axes (e.g., three orthogonal axes) accelerometer, a magnetometer (e.g., compass), a gyroscope, or any combination thereof. Sensors 335 are mounted in fixed relation to microphone array 305 to spin or rotate with microphone array 305 as rotatable component 102 is turned. Communication interface 345 may include one or more wireless transceivers including near-field magnetic induction (NFMI) communication circuitry and antenna, ultra-wideband (UWB) transceivers, a WiFi transceiver, a radio frequency identification (RFID) backscatter tag, a Bluetooth antenna, or otherwise. Interface circuitry 350 may include a capacitive touch sensor disposed across the distal surface of electronics package 205 to support touch commands and gestures on the outer portion of the puck-like surface, as well as a rotary user interface (e.g., rotary encoder) to support rotary commands by rotating the puck-like surface of electronics package 205. A mechanical push button interface operated by pushing on electronics package 205 may also be implemented.

Figure 4:
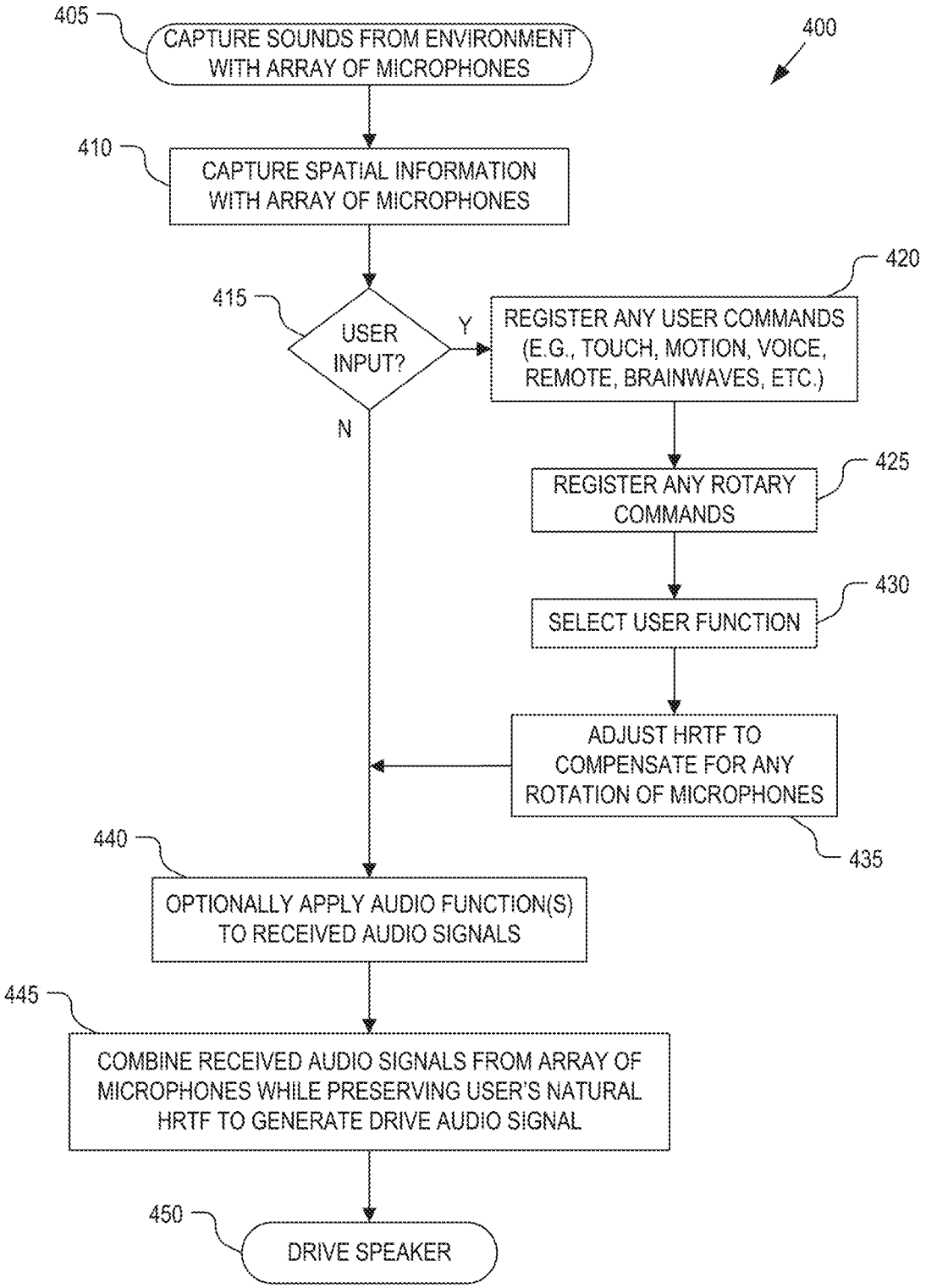
FIG. 4 is a flow chart illustrating operation of the ear-mountable listening device, in accordance with an embodiment of the disclosure.

FIG. 4 is a flow chart illustrating a process 400 for regular operation of ear-mountable listening device 100, in accordance with an embodiment of the disclosure. The order in which some or all of the process blocks appear in process 400 should not be deemed limiting. Rather, one of ordinary skill in the art having the benefit of the present disclosure will understand that some of the process blocks may be executed in a variety of orders not illustrated, or even in parallel.

In a process block 405, sounds from the external environment incident upon array 305 are captured with microphones 310. Due to the plurality of microphones 310 along with their physical separation, the spaciousness or spatial information of the sounds is also captured (process block 410). By organizing microphones 310 into a ring pattern (e.g., circular array) with equal angular increments about central axial axis 225, the spatial separation of microphones 310 is maximized for a given area thereby improving the spatial information that can be extracted by compute module 325 from array 305. Of course, other geometries may be implemented and/or optimized to capture various perceptually relevant acoustic information by sampling some regions more densely than others. In the case of binaural listening system 101 operating with linked microphone arrays, additional spatial information can be extracted from the pair of ear devices 100 related to interaural differences. For example, interaural time differences of sounds incident on each of the user's ears can be measured to extract spatial information. Level (or volume) difference cues can be analyzed between the user's ears. Spectral shaping differences between the user's ears can also be analyzed. This interaural spatial information is in addition to the intra-aural time and spectral differences that can be measured across a single microphone array 305. All of this spatial/spectral information can be captured by arrays 305 of the binaural pair and extracted from the incident sounds emanating from the user's environment.

Spatial information includes the diversity of amplitudes and phase delays across the acoustical frequency spectrum of the sounds captured by each microphone 310 along with the respective positions of each microphone. In some embodiments, the number of microphones 310 along with their physical separation (both within a single ear-mountable listening device and across a binaural pair of ear-mountable listening devices worn together) can capture spatial information with sufficient spatial diversity to localize the origination of the sounds within the user's environment. Compute module 325 can use this spatial information to recreate an audio signal for driving speaker(s) 320 that preserves the spaciousness of the original sounds (in the form of phase delays and amplitudes applied across the audible spectral range). In one embodiment, compute module 325 is a neural network trained to leverage the spatial information and reassert, or otherwise preserve, the user's natural HRTF so that the user's brain does not need to relearn a new HRTF when wearing ear-mountable listening device 100. In yet another embodiment, compute module 325 includes one or more DSP modules. By monitoring the rotational position of microphone array 305 in real-time and applying a rotational correction, the HRTF is preserved despite rotational variability. While the human mind is capable of relearning new HRTFs within limits, such training can take over a week of uninterrupted learning. Since a user of ear-mountable listening device 100 (or binaural listening system 101) would be expected to wear the device some days and not others, or for only part of a day, preserving/reasserting the user's natural HRTF may help avoid disorientating the user and reduce the barrier to adoption of a new technology.

In a decision block 415, if any user inputs are sensed, process 400 continues to process blocks 420 and 425 where any user commands are registered. In process block 420, user commands may be touch commands (e.g., via a capacitive touch sensor or mechanical button disposed in electronics package 205), motion commands (e.g., head motions or other gestures such as nods sensed via a motion sensor in electronics package 205), voice commands (e.g., natural language, vocal noises, or other noises sensed via internal microphone 355 and/or array 305), a remote command issued via external remote 360, or brainwaves sensed via brainwave sensors/electrodes disposed in or on ear devices 100 (process block 420). Touch commands may even be received as touch gestures on the distal surface of electronics package 205.

User commands may also include rotary commands received via rotating electronics package 205 (process block 425). The rotary commands may be determined using the IMU to sense each rotational detent via sensing changes in the constant gravitational or magnetic field vectors. These vectors may be low pass filtered to filter out higher frequency noise. Upon registering a user command, compute module 325 selects the appropriate function, such as volume adjust, skip/pause song, accept or end phone call, enter enhanced voice mode, enter active noise cancellation mode, enter acoustical beam steering mode, or otherwise (process block 430).

Once the user rotates electronics package 205, the angular position of each microphone 310 in microphone array 305 is changed. This requires rotational compensation or transformation of the HRTF to maintain meaningful state information of the spatial information captured by microphone array 305. Accordingly, in process block 435, compute module 325 applies the appropriate rotational correction (e.g., transformation matrix) to compensate for the new positions of each microphone 310. Again, in one embodiment, input from the IMU may be used to apply an instantaneous transformation.

In a process block 440, the audio data and/or spatial information captured by microphone array 305 may be used by compute module 325 to apply various audio processing functions (or implement other user functions selected in process block 430). For example, the user may rotate electronics package 205 to designate an angular direction for acoustical beamforming. This angular direction may be selected relative to the user's front to position a null 125 (for selectively muting an unwanted sound) or a maxima lobe 130 (for selectively amplifying a desired sound). Other audio functions may include filtering spectral components to enhance a conversation, adjusting the amount of active noise cancellation, adjusting perceptual transparency, etc.

In a process block 445, one or more of the audio signals captured by the microphone array 305 are intelligently combined to generate an audio signal for driving the speaker (s) 320 (process block 450). The audio signals output from microphone array 305 may be combined and digitally processed to implement the various processing functions. For example, compute module 325 may analyze the audio signals output from each microphone 310 to identify one or more "lucky microphones." Lucky microphones are those microphones that due to their physical position happen to acquire an audio signal with less noise than the others (e.g., sheltered from wind noise). If a lucky microphone is identified, then the audio signal output from that microphone 310 may be more heavily weighted or otherwise favored for generating the audio signal that drives speaker 320. The data extracted from the other less lucky microphones 310 may still be analyzed and used for other processing functions, such as localization.

In one embodiment, the processing performed by compute module 325 may preserve the user's natural HRTF thereby preserving their normal sense of spaciousness including a sense of the size and nature of the space around them as well as the ability to localize the physical direction from where the original environmental sounds originated. In other words, the user will be able to identify the directional source of sounds originating in their environment despite the fact that the user is hearing a regenerated version of those sounds emitted from speaker 320. The sounds emitted from speaker 320 recreate the spaciousness of the original environmental sounds in a way that the user's mind is able to faithfully localize the sounds in their environment. In one embodiment, reassertion of the natural HRTF is a calibrated feature implemented using machine learning techniques and trained neural networks. In other embodiments, reassertion of the natural HRTF is implemented via traditional signal processing techniques and some algorithmically driven analysis of the listener's original HRTF or outer ear morphology. Regardless, a rotational correction can be applied to the audio signals captured by microphone array 305 by compute module 325 to compensate for rotational variability in microphone array 305.

Figure 5A:
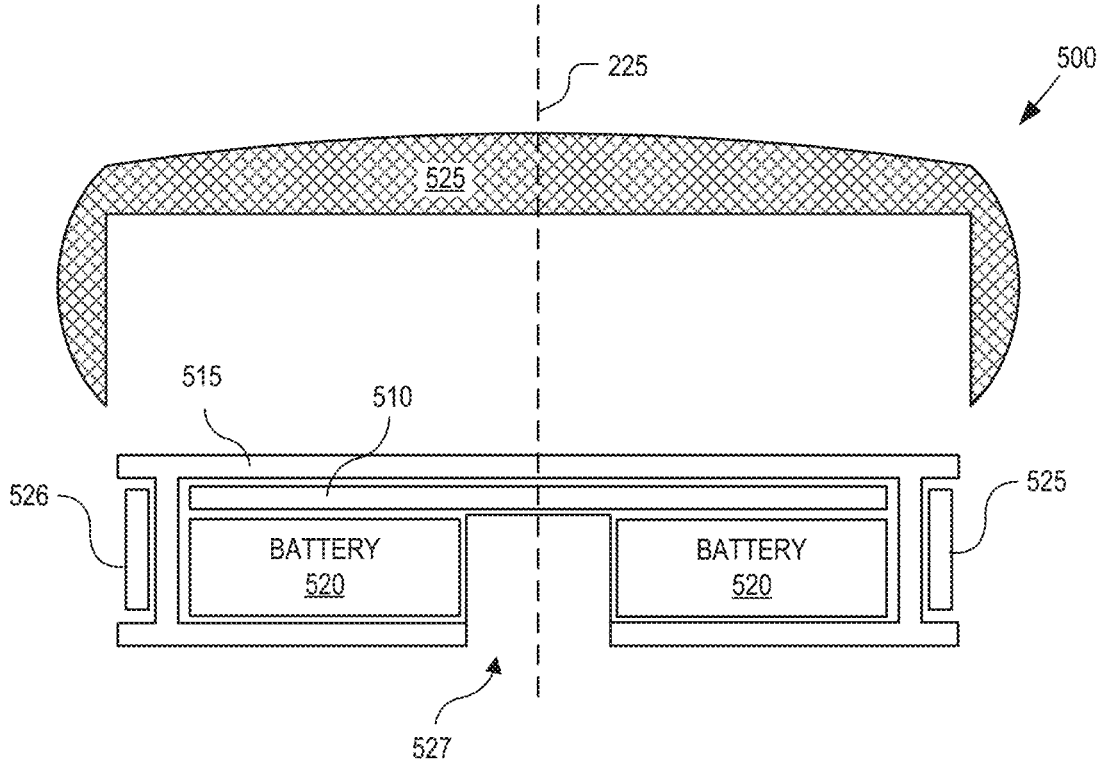
FIGS. 5A & 5B illustrate an electronics package of the ear-mountable listening device including an array of microphones disposed in a ring pattern around a main circuit board, in accordance with an embodiment of the disclosure.
Figure 5B:
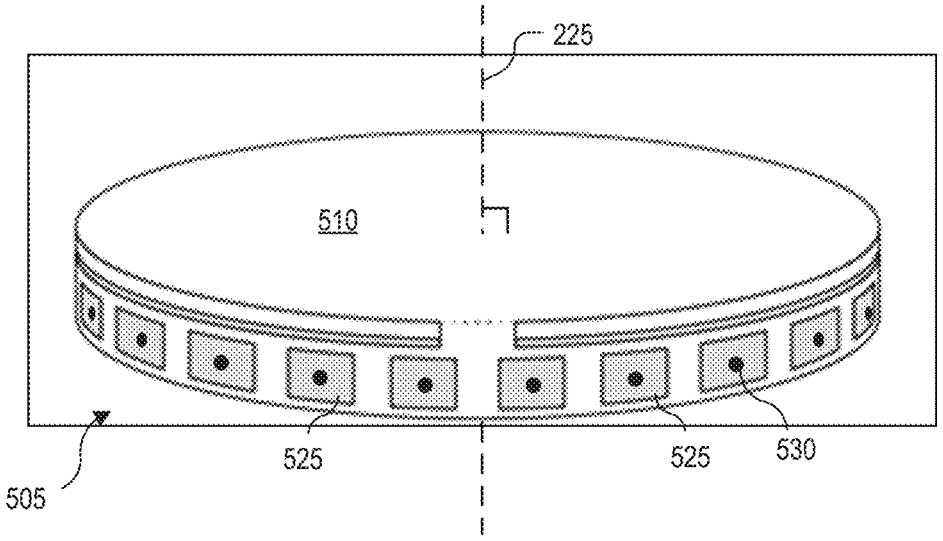

FIGS. 5A & 5B illustrate an electronics package 500, in accordance with an embodiment of the disclosure. Electronics package 500 represents an example internal physical structure implementation of electronics package 205 illustrated in FIG. 2. FIG. 5A is a cross-sectional illustration of electronics package 500 while FIG. 5B is a perspective view illustration of the same excluding cover 525. The illustrated embodiment of electronics package 500 includes an array 505 of microphones, a main circuit board 510, a housing or frame 515, a cover 525, and a rotary port 527. Each microphone within array 505 is disposed on an individual microphone substrate 526 and includes a microphone port 530.

FIGS. 5A & 5B illustrate how array 505 extends around central axial axis 225. Additionally, in the illustrated embodiment, array 505 extends around a perimeter of main circuit board 510. Although not illustrated, main circuit board 510 includes electronics disposed thereon, such as compute module 325, memory 330, sensors 335, communication circuitry 345, and interface circuitry 350. Main circuit board 510 is illustrated as a solid disc having a circular shape; however, in other embodiments, main circuit board 510 may be an annular disk with a central hole through which post 220 extends to accommodate protrusion of acoustic drivers aligned with the ear canal entrance. In the illustrated embodiment, the surface normal of main circuit board 510 is parallel to and aligned with central axial axis 225 about which the ring pattern of array 505 extends.

The electronics may be disposed on one side, or both sides, of main circuit board 510 to maximize the available real estate. Housing 515 provides a rigid mechanical frame to which the other components are attached. Cover 525 slides over the top of housing 515 to enclose and protect the internal components. In one embodiment, a capacitive touch sensor is disposed on housing 515 beneath cover 525 and coupled to the electronics on main circuit board 510. Cover 525 may be implemented as a mesh material that permits acoustical waves to pass unimpeded and is made of a material that is compatible with capacitive touch sensors (e.g., non-conductive dielectric material).

As illustrated in FIGS. 5A & 5B, array 505 encircles a perimeter of main circuit board 510 with each microphone disposed on an individual microphone substrate 526. In the illustrated embodiment, microphone ports 530 are spaced in substantially equal angular increments about central axial axis 225. Of course, other nonequal spacings may also be implemented. The individual microphone substrate 526 are planer substrates oriented vertical (in the figure) or perpendicular to main circuit board 510 and parallel with central axial axis 225. However, in other embodiments, the individual microphone substrates may be tilted relative to central axial axis 225 and the normal of main circuit board 510. Of course, the microphone array may assume other positions and/or orientations within electronics package 205.

FIG. 5A illustrates an embodiment where main circuit board 510 is a solid disc without a central hole. In that embodiment, post 220 of acoustic package 210 extends into rotary port 527, but does not extend through main circuit board 510. The inside surface of rotary port 527 may include magnets for holding acoustic package 210 therein and conductive contacts for making electrical connections to electrical trace rings 230. Of course, in other embodiments, main circuit board 510 may be an annulus with a center hole 605 allowing post 230 to extend further into electronics package 205 enabling thinner profile designs. A center hole in main circuit board 510 provides additional room or depth for larger acoustic drivers within post 220 of acoustic package 205 to be aligned directly in front of the entrance to the user's ear canal.

Figure 6A:
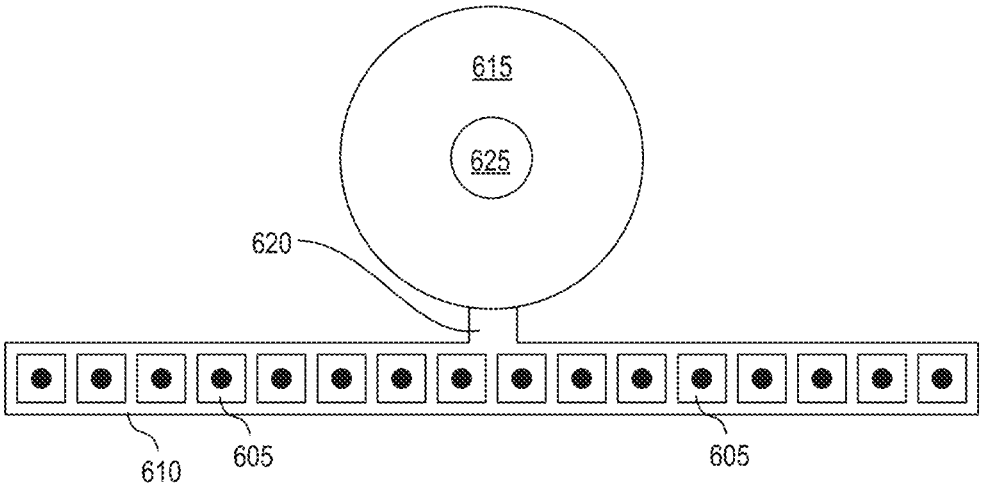
FIGS. 6A and 6B illustrate individual microphone substrates interlinked into the ring pattern via a flexible circumferential ribbon that encircles the main circuit board, in accordance with an embodiment of the disclosure.
Figure 6B:
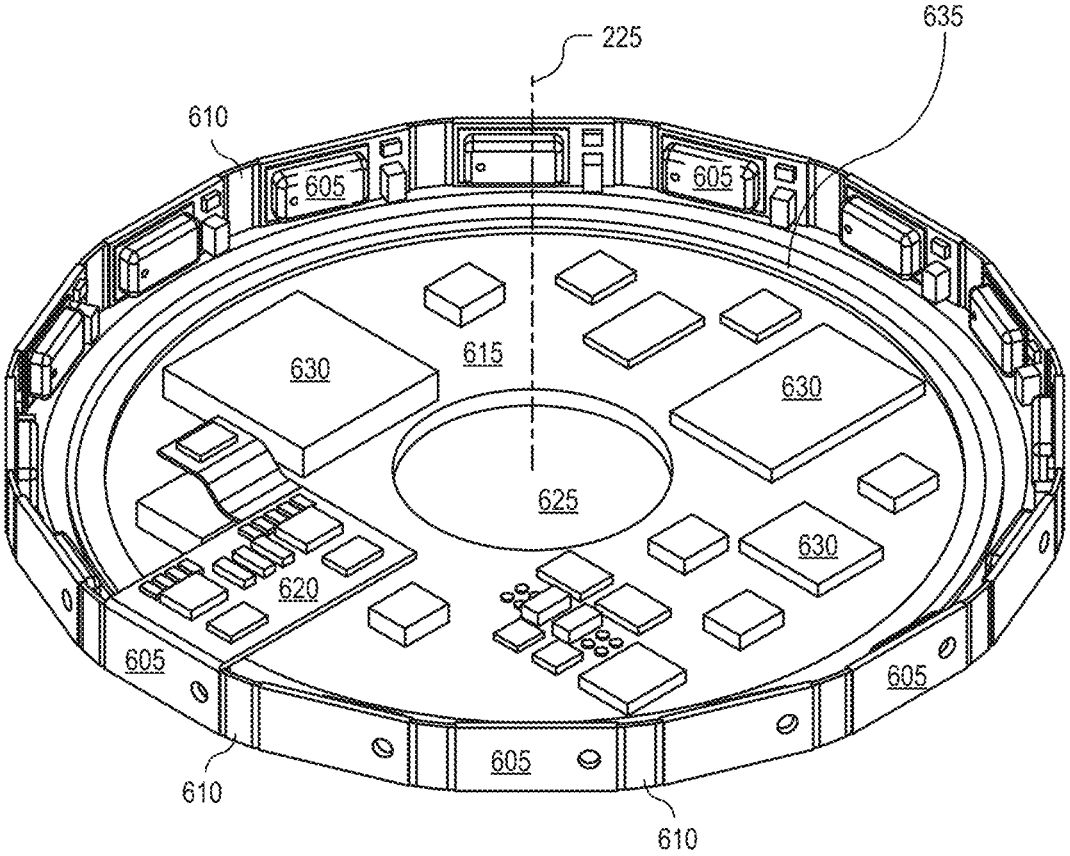

FIGS. 6A and 6B illustrate individual microphone substrates 605 interlinked into a ring pattern via a flexible circumferential ribbon 610 that encircles a main circuit board 615, in accordance with an embodiment of the disclosure. FIGS. 6A and 6B illustrate one possible implementation of some of the internal components of electronics package 205 or 500. As illustrated in FIG. 6A, individual microphone substrates 605 may be mounted onto flexible circumferential ribbon 610 while rolled out flat. A connection tab 620 provides the data and power connections to the electronics on main circuit board 615. After assembling and mounting individual microphone substrates 605 onto ribbon 610, it is flexed into its circumferential position extending around main circuit board 615, as illustrated in FIG. 6B. As an example, main circuit board 615 is illustrated as an annulus with a center hole 625 to accept post 220 (or component protrusions therefrom). Furthermore, the individual electronic chips 630 (only a portion are labeled) and perimeter ring antenna 635 for near field communications between a pair of ear devices 100 are illustrated merely as demonstrative implementations. Of course, other mounting configurations for microphones 605 and microphone substrates 610 may be implemented.

Figure 7:
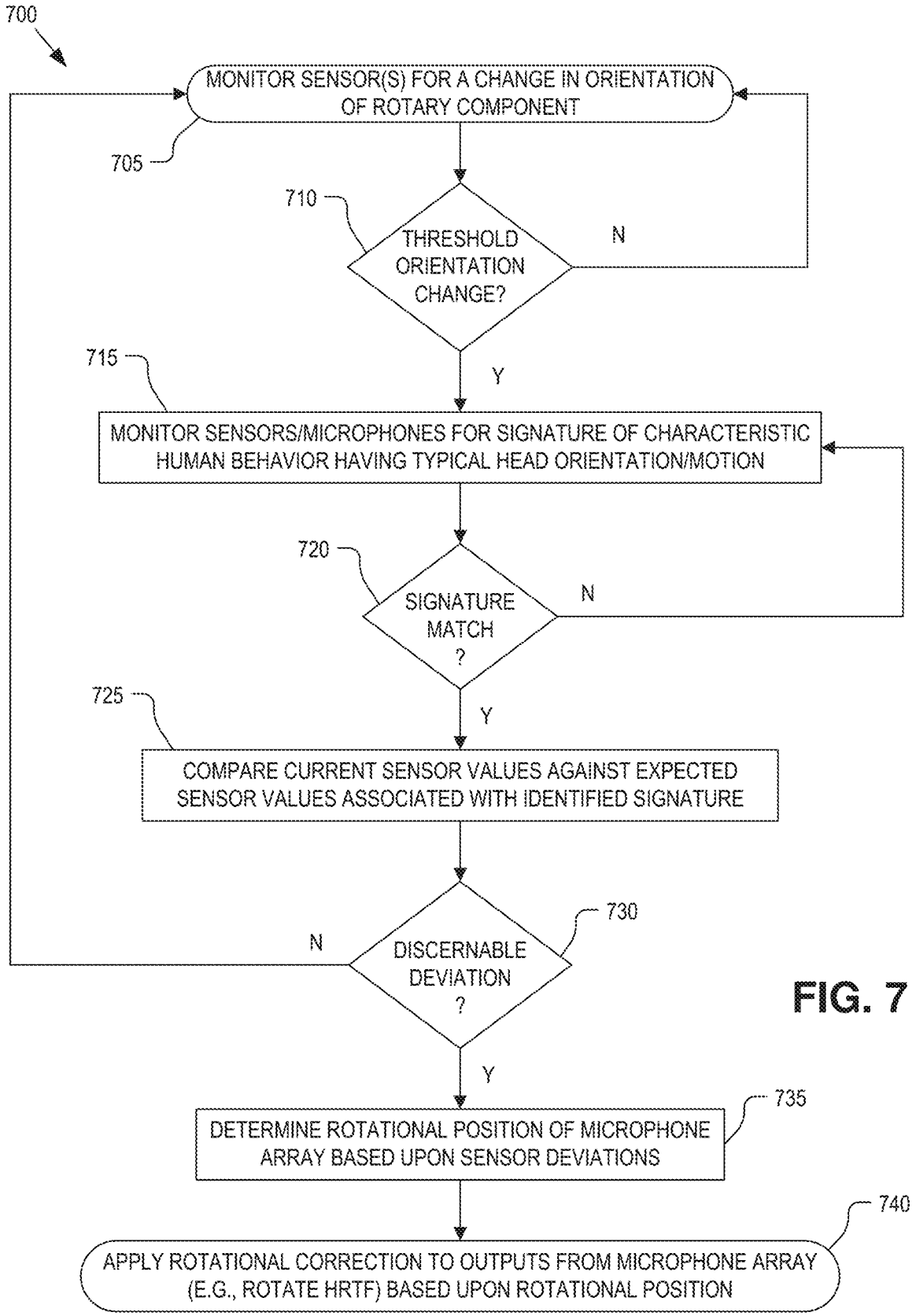
FIG. 7 is a flow chart illustrating a process for orientation discovery of the microphone array and applying a rotational correction, in accordance with an embodiment of the disclosure.

FIG. 7 is a flow chart illustrating a process 700 for orientation discovery of microphone array 305 and applying a rotational correction during operational use, in accordance with an embodiment of the disclosure. The order in which some or all of the process blocks appear in process 700 should not be deemed limiting. Rather, one of ordinary skill in the art having the benefit of the present disclosure will understand that some of the process blocks may be executed in a variety of orders not illustrated, or even in parallel.

In a process block 705, sensors 335 are monitored for a change in orientation of rotary component 102. The monitored sensors 335 may include one or more accelerometers, a gyroscope, a magnetometer etc. of an IMU. In the illustrated embodiment, compute module 325 initially monitors sensors 335 for an indication that rotary component 102 has been rotated. This indication may include monitoring for a threshold motion or change in orientation (decision block 710). For example, compute module 325 may monitor sensors 335 for threshold changes in the direction of the constant gravity vector or constant magnetic field vector. The sensors may be low pass filtered to reject high frequency motions, integrated, or other noise reduction operations applied. However, simply searching for a threshold change in direction of these vectors, while being an indication of possible rotation of the microphone array 305 relative to the user's ear, is not determinative. Overall head motions should still be disambiguated from rotations relative to the user's ear (e.g., the user may simply have tilted their head in a particular manner). To disambiguate head motions from rotations of rotary component 102 relative to the ear, compute module 325 commences monitoring sensor outputs and/or onboard microphone outputs to search for a sensor signature match indicating that the user is performing a characteristic human behavior having an associated typical head orientation or typical head motion (process block 715). Of course, in other embodiments, compute module 325 may constantly search for signature matches without first waiting for threshold orientation changes though doing so may place a heavier burden on battery 340.

Sensor signatures may include a motion signature component and/or an audible signature component. The motion signature component is based upon sensors 335 (e.g., IMU outputs). The motion signature component searches for motions or orientations indicative of a characteristic human behavior or activity. Similarly, the audio signature component is based upon sounds captured by an onboard microphone such as microphone array 305 or internal microphone 335. Certain characteristic human behaviors or activities may have typical sounds or sound patterns associated with them.

FIG. 8 illustrates an example library 331 storing sensor signatures representative of a plurality of different characteristic human behaviors, in accordance with an embodiment of the disclosure. Sensor library 331 may be stored in memory 330 and accessed by compute module 325 when searching for a signature match (decision block 720). The illustrated embodiment of library 331 includes four sensor signatures: 1 through 4. Some sensor signatures include only a motion signature component (e.g., sensor signature 1 corresponding to walking), while other sensor signatures may include both a motion signature component and an audible signature component (e.g., sensor signature 2 corresponding to jogging). In yet other instances, a particular sensor signature may only include an audible sensor signature (e.g., drinking/eating). The sensor signatures themselves are sensor values and/or sensor patterns along with audible sounds or audible patterns that are present during a particular characteristic human behavior and thus indicate the occurrence of such characteristic human behavior or activity.

Library 331 is merely demonstrative and not intended to be an exclusive list of all characteristic human behaviors having typical head orientations/motions. The illustrated embodiment includes sensor signatures associated with (or indicative of) walking, jogging, nodding, and drinking/eating. Walking or jogging may be identified by certain rhythmic accelerations and correlated breathing sounds. When a human is walking or jogging, the head is typically held in a level orientation or level attitude. Similarly, nodding may be identified by certain up and down accelerations in a vertical plane. Finally, drinking and/or eating may also be identified by certain sounds, particularly via internal microphone 355. Once identified, drinking and/or eating may then be associated with certain typical head motions or orientations. Of course, other sensor data and inferences may be analyzed to accept or reject a particular measured signature as being indicative of a particular characteristic human behavior.

Returning to FIG. 7, once a signature match is found (decision block 720), the current sensor values output from sensors 335 may be compared to a set of expected sensor values associated with the identified characteristic human behavior (process block 725). These expected sensor values are the values that would be expected when the user holds their head in the expected orientation or moves their head along the expected motion path. Since the head is expected to be held level when jogging, if the current sensor values deviate from a level position (decision block 730), then it may be assumed by compute module 325 that rotatory component 102 has been rotated relative to the ear and the deviation is disambiguated from an overall head orientation or motion. The magnitude and direction of the deviations may be used to determine the rotational position of rotary component 102 and thus the orientation of microphone array 305 (process block 735). Finally, in a process block 740, the appropriate rotational correction is applied to the audio signals output from microphone array 305 when driving speaker 320. The rotational correction may be a transformation matrix, a correction filter, a selection of a particular set of correction coefficients, a rotational remapping of microphone positions, or otherwise that preserves the user's HRTF despite rotational changes in microphone array 305 relative to the user's ear.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An ear-mountable listening device, comprising:

an array of microphones configured to capture sounds emanating from an environment and output first audio signals representative of the sounds, wherein the array of microphones has a rotational position that is variable relative to an ear of a user;

a speaker arranged to emit audio into the ear in response to a second audio signal;

sensors mounted in a fixed relation to the array of microphones to rotate with the array of microphones; and electronics coupled to the array of microphones and the speaker, the electronics including logic that when executed by the electronics causes the ear-mountable listening device to perform operations including:

analyzing outputs of the sensors to identify a signature match representative of an occurrence of a characteristic human behavior having at least one of a typical head orientation or a typical head motion associated with the characteristic human behavior;

in response to identifying the signature match, comparing current sensor values output from the sensors to expected sensor values associated with the signature match; and applying a rotational correction to the first audio signals to generate the second audio signal that drives the speaker, the rotational correction determined based at least in part upon a deviation of the current sensor values from the expected sensor values.

2. The ear-mountable listening device of claim 1, wherein the electronics include further logic that when executed by the electronics causes the ear-mountable listening device to perform further operations comprising:

determining the rotational position of the array of microphones based upon the deviation of the current sensor values from the expected sensor values.

3. The ear-mountable listening device of claim 1, wherein the characteristic human behavior is walking or jogging.

4. The ear-mountable listening device of claim 3, wherein the typical head orientation associated with walking or jogging is a level head orientation.

5. The ear-mountable listening device of claim 1, wherein the characteristic human behavior is nodding and the typical head motion associated with nodding is an up and down motion.

6. The ear-mountable listening device of claim 1, wherein the characteristic human behavior is eating or drinking.

7. The ear-mountable listening device of claim 1, wherein the electronics include further logic that when executed by the electronics causes the ear-mountable listening device to perform further operations comprising:

monitoring the sensors for a threshold change in an orientation of the array of microphones;

in response to identifying the threshold change in the orientation of the array of microphones, monitoring the outputs of the sensors for the signature match after identifying the threshold change to disambiguate whether the threshold change was due to a change in head orientation or position, or a change in the rotational position of the array of microphones relative to the ear.

8. The ear-mountable listening device of claim 7, wherein monitoring the sensors for the threshold change in the orientation of the array of microphones comprises monitoring the sensors for a change in direction of a gravity vector.

9. The ear-mountable listening device of claim 1, wherein analyzing the outputs of the sensors to identify the signature match representative of the occurence of the characteristic human behavior comprises:

comparing a first signature generated based upon the outputs of the sensors against a library of second signatures representative of a plurality of different characteristic human behaviors.

10. The ear-mountable listening device of claim 1, wherein the sensors comprise an inertial measurement unit (IMU) including one or more of multi-axis accelerometers, a gyroscope, or a magnetometer.

11. The ear-mountable listening device of claim 1, wherein the signature match compares a motion signature component obtained from the sensors and an audible signature component obtained from an onboard microphone disposed within the ear-mountable listening device.

12. The ear-mountable listening device of claim 11, wherein the onboard microphone comprises an internal microphone coupled to the electronics and oriented within the ear-mountable listening device to focus on user sounds emanating via an ear canal of the user when the ear-mountable listening device is worn, wherein the electronics include further logic that when executed by the electronics causes the ear-mountable listening device to perform further operations comprising:

analyzing the user sounds from the internal microphone in conjunction with the outputs from the sensors to identify the signature match.

13. The ear-mountable listening device of claim 1, wherein the array of microphones is disposed within a rotatable component of the ear-mountable listening device, the rotatable component rotatable to provide a user interface for controlling at least one user selectable function of the ear-mountable listening device.

14. The ear-mountable listening device of claim 1, wherein the rotational correction applied to the first audio signals comprises a rotational transformation applied by the electronics to the first audio signals that preserves spaciousness of the sounds emanating from the environment such that the user can localize the sounds based upon the audio emitted from the speaker despite rotation of the array of microphones.

15. A method of operation of an ear-mountable listening device, the method comprising:

generating first audio signals representative of sounds emanating from an environment and captured with an array of microphones of the ear-mountable listening device mounted to an ear;

identifying an occurrence of a characteristic human behavior having at least one of a typical head orientation or a typical head motion associated with the characteristic human behavior by monitoring sensors mounted in a fixed relation to the array of microphones, wherein the sensors and the array of microphones are rotatable together;

determining a rotational position of the array of microphones relative to the ear based at least in part upon identifying the occurence of the characteristic human behavior;

applying a rotational correction to the first audio signals to generate a second audio signal, wherein the rotational correction is based at least in part upon the rotational position; and driving a speaker of the ear-mountable listening device with the second audio signal to output audio into the ear.

16. The method of claim 15, wherein identifying the occurence of the characteristic human behavior comprises:

analyzing outputs of the sensors to match a motion signature associated with the characteristic human behavior.

17. The method of claim 16, wherein identifying the occurrence of the characteristic human behavior further comprises:

analyzing user sounds captured from an onboard microphone of the ear-mountable listening device to match an audible signature indicative of the characteristic human behavior.

18. The method of claim 16, wherein determining the rotational position of the array of microphones comprises:

in response to matching the motion signature, determining a deviation between current sensor values output from the sensors and expected sensor values associated with the characteristic human behavior.

19. The method of claim 15, wherein the array of microphones is disposed within a rotatable component of the ear-mountable listening device, the method further comprising:

adjusting a user selectable function of the ear-mountable listening device in response to rotation of the rotatable component.

20. The method of claim 15, wherein the sensors comprise an inertial measurement unit (IMU) including one or more of multi-axis accelerometers, a gyroscope, or a magnetometer.

21. The method of claim 15, further comprising:

using the rotational correction to preserve spaciousness of the sounds in the audio output from the speaker such that the user can localize the sounds in the environment based upon the audio output from the speaker despite rotation of the array of microphones.

* * * * *